United States Patent [19]

Rutten

[11] Patent Number: 4,607,605

[45] Date of Patent: Aug. 26, 1986

[54] PROJECTILE DISTRIBUTOR FOR CENTRIFUGAL LAUNCHER

[76] Inventor: Léon L. Rutten, 20 Rue Duvivier, 4000 Liege, Belgium

[21] Appl. No.: 457,963

[22] Filed: Jan. 14, 1983

[30] Foreign Application Priority Data

Jan. 22, 1982 [BE] Belgium ..... 2/59552

[51] Int. Cl.[4] ..... F41B 3/04

[52] U.S. Cl. ..... 124/6; 124/53; 124/82; 124/41 R

[58] Field of Search ..... 124/6, 41 B, 41 R, 51 R, 124/53, 82

[56] References Cited

U.S. PATENT DOCUMENTS

| | | | |
|---|---|---|---|
| 1,408,137 | 2/1922 | Parsons | 124/6 |
| 1,420,660 | 6/1922 | Lombard | 124/6 |
| 1,783,053 | 11/1930 | Baden-Powell . | |
| 2,311,937 | 2/1943 | Elliott | 124/6 |
| 2,391,636 | 12/1945 | McArthur | 124/6 X |
| 3,177,862 | 4/1965 | Allemann | 124/6 |
| 3,548,802 | 12/1970 | Green | 124/82 |
| 3,646,888 | 3/1972 | Posson et al. . | |

FOREIGN PATENT DOCUMENTS

| | | | |
|---|---|---|---|
| 146380 | 5/1952 | Australia | 124/53 |
| 53855 | 6/1982 | European Pat. Off. | 124/6 |
| 503486 | 3/1920 | France . | |
| 795554 | 1/1936 | France | 124/6 |
| 869555 | 11/1941 | France | 124/6 |
| AD.373 | of 1912 | United Kingdom | 124/6 |

*Primary Examiner*—Richard J. Apley
*Assistant Examiner*—John Welsh
*Attorney, Agent, or Firm*—Bacon & Thomas

[57] ABSTRACT

A distributor for feeding projectiles to the trajectory of a projectile engaging vane carried by a cylindrical gun in a centrifugal launcher of the type including a rotor having an open central zone, the distributor being defined by a support provided with a transfer zone and a passage for storing a plurality of projectiles that are fed by a jack into the transfer zone for successive engagement by a slide, the latter being periodically advanced in synchronization with rotation of the rotor to engage and bring each projectile against an anvil and in the trajectory of the projectile engaging vane. The slide blocks the passage while in its advanced position, and unblocks the passage when retracted to permit feeding of the projectiles into the transfer zone. An engagable lock maintains the slide in the advanced position in opposition to its retraction.

10 Claims, 4 Drawing Figures

PROJECTILE DISTRIBUTOR FOR CENTRIFUGAL LAUNCHER

BACKGROUND OF THE INVENTION

The present invention relates to a projectile distributor for a centrifugal launcher.

The type of centrifugal launcher considered here substantially consists of a rotor including a cylindrical gun, the rotor having an open central zone in which emerges an end of the gun provided with a picking-up vane. The object of the distributor according to the invention is to bring oblong projectiles successively into the trajectory of the aforesaid vane, in order to allow the latter to take them over, thus allowing their ejection through the gun.

SUMMARY OF THE INVENTION

For this purpose, the distributor according to the invention substantially comprises the combination: of a support carrying a passage component intended for receiving a plurality of oblong projectiles arranged side by side, this passage leading to a transfer zone arranged in the aforesaid support; of a slide arranged in the aforesaid transfer zone; of a means for periodically advancing the slide in synchronism with the rotation of the rotor to an advanced position where it blocks the aforesaid passage; of a drawback-means for bringing the slide into a retracted position where it unblocks the aforesaid passage; of a locking means for temporarily maintaining the slide in an advanced position in opposition to the aforesaid drawback-means; and of a means for feeding the projectiles in the aforesaid passage towards the aforesaid transfer zone.

BRIEF DESCRIPTION OF THE DRAWINGS

In order to provide a detailed description of the characteristics of the invention, an embodiment of the invention is described hereinafter as a merely illustrative and not restrictive example, reference being made to the attached drawings, in which.

DETAILED DESCRIPTION OF THE PREFERRED EMBODIMENT

Figure 1:
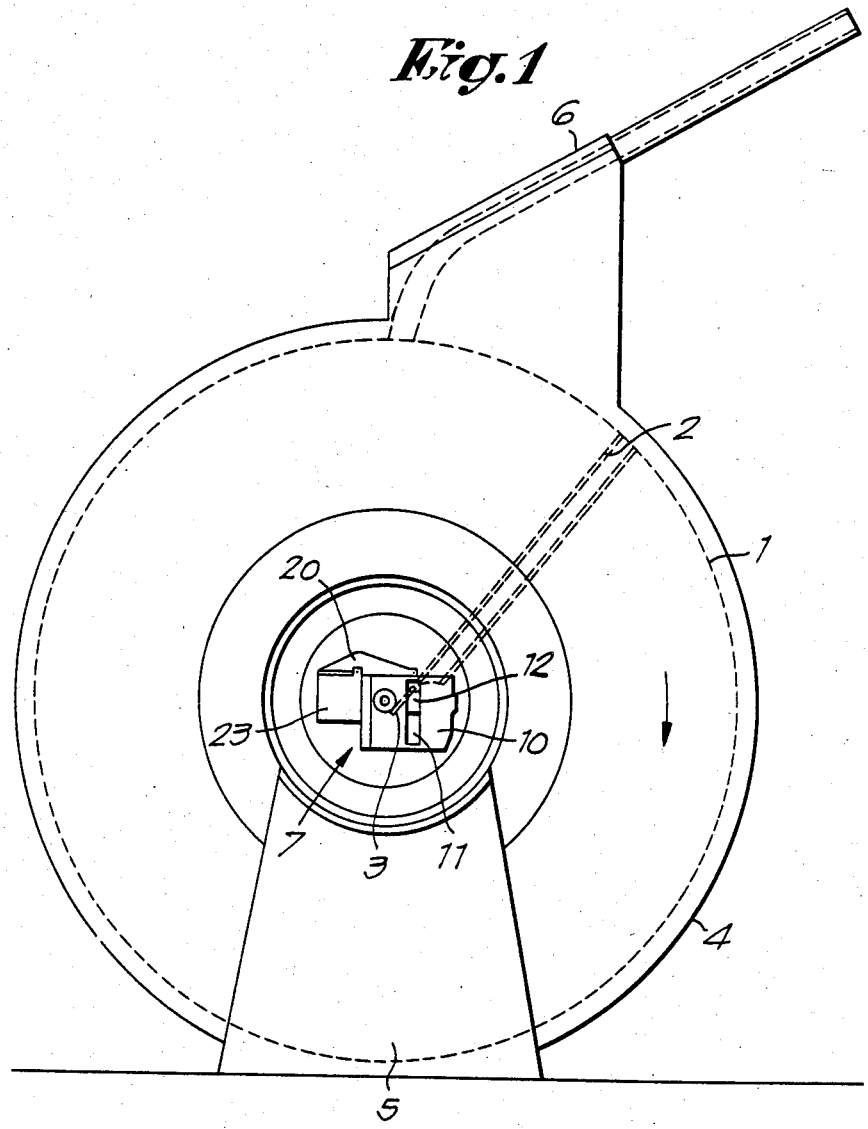
FIG. 1 is a view in elevation of a centrifugal launcher equipped with a distributor according to the invention.
Figure 2:
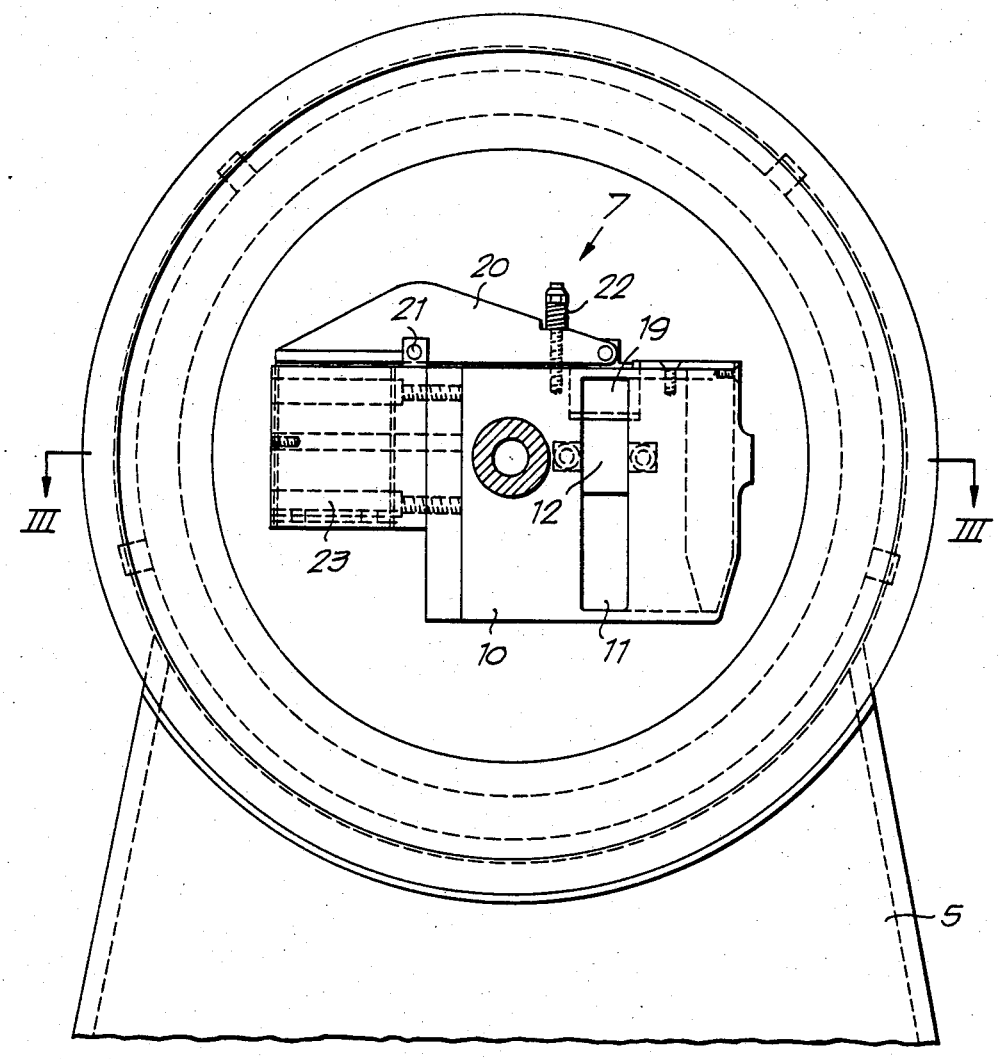
FIG. 2 is a view on a larger scale of the central part of FIG. 1, situated by means of the line II—II of FIG. 3.

A type of centrifugal launcher to which the invention can be applied is schematized in FIG. 1. It comprises a rotor 1 containing a cylindrical gun 2, the whole being apt to be driven so as to rotate, for instance by means of a turbine, which is not shown. The rotor 1 has an open central zone in which there is a picking-up vane 3 prolonging the gun 2. The axis of the latter and the axis of rotation of the rotor 1 are two skew straight lines. More details on this construction may be found in the Belgian Pat. No. 886.482.

A careening protection jacket 4 encompasses the rotor 1 and is mounted so as to be angularly adjustable on the support 5. The careening jacket 4 carries a rectifying device 6 intended for ensuring a correct attitude of the projectiles after they have left the gun 2.

The function of the distributor 7 according to the invention is to bring projectiles 8 one by one into the trajectory of the picking-up vane 3, which takes them in charge and permits their penetration into the gun 2 under the action of the centrifugal force and thus their ejection.

The distributor 7 comprises a passage component 9 fixed on a support 10 and leading to a transfer zone 11 provided for in the latter.

The passage 9 is intended for receiving a plurality of oblong shells 8 arranged side by side.

In the transfer zone 11 there is housed a slide 12 which is apt to be moved in one direction by the nose 13 of a cam 14 and in the other direction by drawback springs 15.

This cam is being driven by the driving shaft 16 of the rotor 1, via a pinion-shaft 17 driving a crown wheel 18 which is rigidly locked with the cam 14.

The return of the slide 12 under the action of the springs 15 can be prevented by a check knife 19 carried on the end of a rocker 20 pivoted at 21 on an electromagnet 23 described hereinafter and carried by the support 10.

A spring 22 draws the rocker to a position in which the check knife opposes the return of the slide 12. The action of the spring 22 can be counteracted by an electro-magnet 23 fixed on the support 10. The latter carries furthermore a rest component or anvil 24 located so as to face the slide 12 and at a distance from the entrance of the transfer zone 11 which is fairly equal to the calibre of the projectiles 8.

Figure 3:
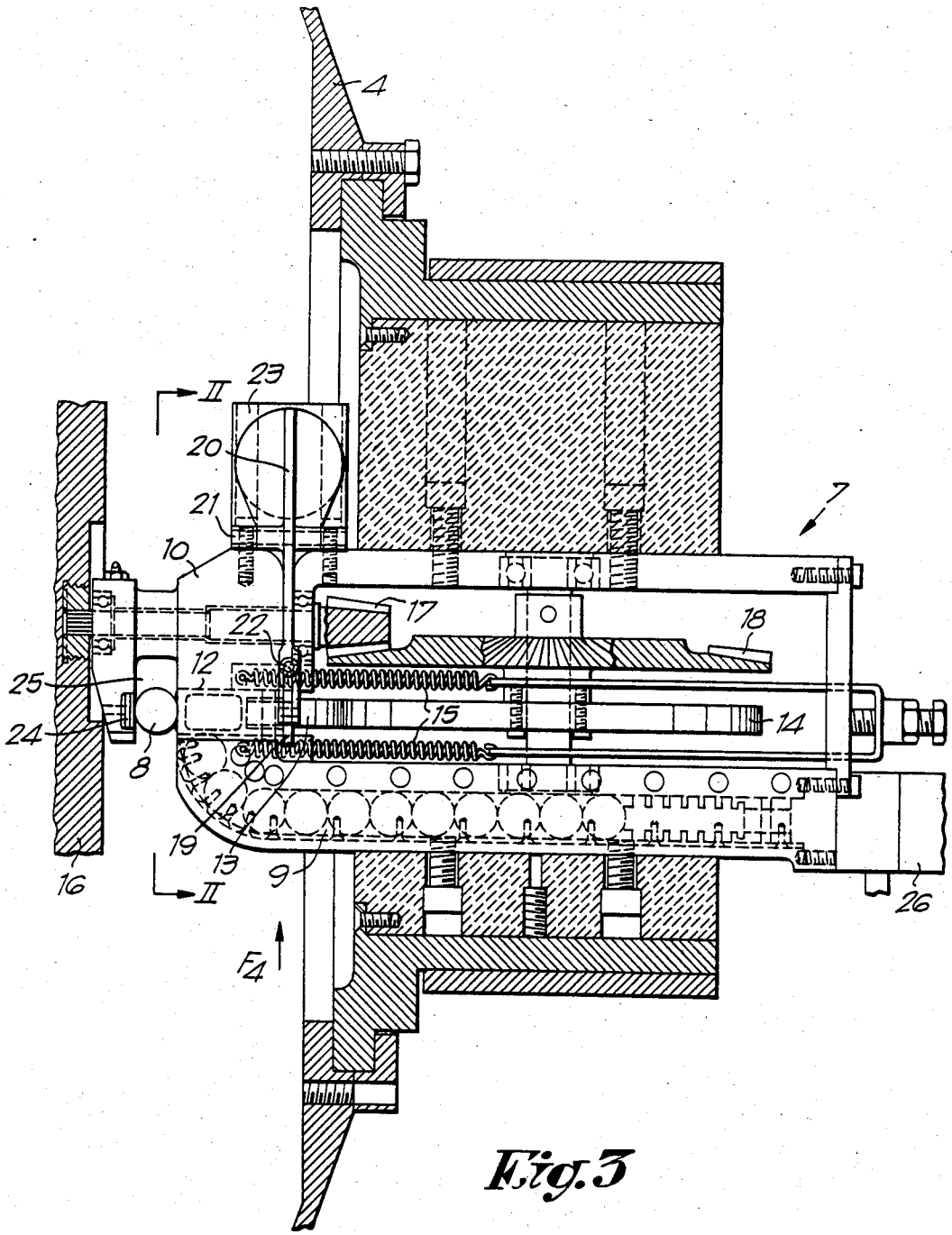
FIG. 3 is a section according to line III—III of FIG. 2.
Figure 4:
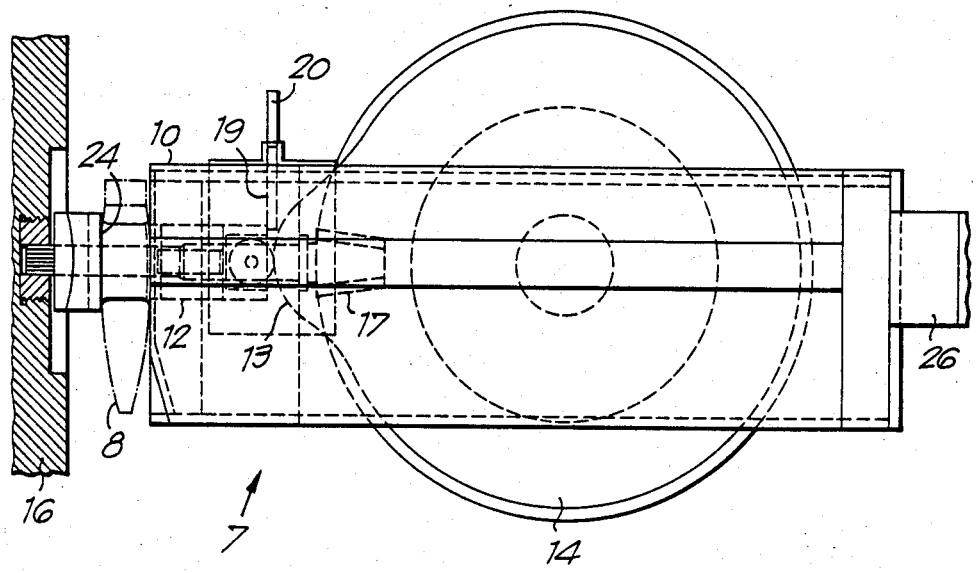
FIG. 4, to end with, is a view according to the arrow F 4 of FIG. 3.

The zone indicated as 25 in FIG. 3 is periodically crossed by the vane 3 of the gun 2 during the rotation of the rotor 1.

Finally, a jack 26 continually pushes the projectiles 8 situated in the passage 9 towards the transfer zone 11.

The functioning of the distributor 7 is as follows.

The "rest position" of the slide 12 is the one that is nearest to the anvil 24, position in which it is kept by the check knife 19 as long as the electro-magnet 23 is not excited. The slide 12 then opposes the feeding of a projectile from the passage 9 under the action of the jack 26.

For bringing a projectile against the anvil 24, thus for shooting, the electro-magnet 23 is briefly energized, which results in the lifting of check knife 19, the return of the slide 12 under the action of the springs 15 and the entry of a projectile in the transfer zone 11. The nose 13 of the cam 14 immediately pushes back the slide 12 which itself pushes back the projectile which has arrived into the transfer zone 11 against the anvil 24, in which position it can be taken in charge by the aforesaid vane 3 when this vane crosses the zone 25.

The frequency of the excitation of the electromagnet 23 determines the rate of fire. The maximum value of the latter depends on the rotational speed of the shaft 16, on the reduction ratio between the pinion 17 and crown wheel 18 and on the number of noses 13 provided on the cam 14.

The feed of the electro-magnet may be controlled by means of an ET gate circuit, the gate becoming a conductor as soon as two signals are received: a command to shoot and a detection of the angular position of the whole careening jacket 4—rectifying device 6—distributor 7, this position determining the shooting range. In order to obtain a desired shooting range, it is preferred to have the whole careening jacket 4—rectifying device 6—distributor 7 turning over a suitable angle around the axis of the rotor, i.e. around the axis of the pinion 17.

It is clear that a great number of changes can be made to the example described hereinabove without departing from the scope of the invention. Thus, the feed mechanism (passage 9, jack 26) could be replaced by another system allowing to load the device in an easier way with a greater number of projectiles.

What I claim is:

1. A distributor for feeding oblong projectiles to the path of a projectile engaging vane carried by a cylindrical gun in a centrifugal launcher of the type including a rotor having an open central zone, and wherein the rotor axis of rotation and longitudinal axis of the gun define two skewed lines, the distributor comprising:

(a) a support provided with a transfer zone and a passage for storing a plurality of oblong projectiles to be fed into the transfer zone;

(b) a slide disposed in the transfer zone for successively engaging the oblong projectiles;

(c) an anvil carried by the support and positioned opposite the slide in an open central zone of a rotor;

(d) means for periodically advancing the slide to a first position in synchronization with rotation of the rotor to engage and bring each oblong projectile against the anvil and in the path of a projectile engaging vane, wherein the slide blocks the passage while in the first position;

(e) means for retracting the slide to a second position wherein the slide unblocks the passage;

(f) means for maintaining the slide in the first position in opposition to the retraction means, including a movable knife biased towards a locking position in engagement with the slide and electromagnet means for moving the knife into an unlocking position out of engagement with the slide; and (g) means for feeding the oblong projectiles through the passage to the transfer zone.

2. The distributor of claim 1 wherein the means for periodically advancing the slide to the first position includes:

(a) a rotatable cam; and (b) a reduction gear means operatively connecting the rotor and the cam.

3. The distributor of claim 1 wherein the means for retracting the slide to the second position includes at least one spring carried by the support.

4. The distributor of claim 1 wherein the means for feeding the projectiles through the passage to the transfer zone includes a jack.

5. In combination with a centrifugal launcher having a cylindrical gun and a projectile engaging vane carried by the gun, the launcher being of the type including a rotor having an open central zone wherein the rotor axis of rotation and longitudinal axis of the gun define two skewed lines, a distributor for feeding oblong projectiles to the path of the vane, the distributor comprising:

(a) a support provided with a transfer zone and a passage for storing a plurality of oblong projectiles to be fed into the transfer zone;

(b) a slide disposed in the transfer zone for successively engaging the oblong projectiles;

(c) an anvil carried by the support and positioned opposite the slide in an open central zone of the rotor;

(d) means for periodically advancing the slide to a first position in synchronization with rotation of the rotor to engage and bring each oblong projectile against the anvil and in the path of the projectile engaging vane, wherein the slide blocks the passage while in the first position;

(e) means for retracting the slide to a second position wherein the slide unblocks the passage;

(f) means for maintaining the slide in the first position in opposition to the retraction means; and (g) means for feeding the oblong projectile through the passage to the transfer zone.

6. The combination of claim 5 wherein the means for periodically advancing the slide to the first position includes:

(a) a rotatable cam; and (b) a reduction gear means operatively connecting the rotor and the cam.

7. The combination of claim 5 wherein the means for retracting the slide to the second position includes at least one spring carried by the support.

8. The combination of claim 5 wherein the means for maintaining the slide in the first position in opposition to the retraction means includes:

(a) a movable knife biased towards a locking position in engagement with the slide; and (b) means for moving the knife into an unlocking position out of engagement with the slide.

9. The combination of claim 8 wherein the means for moving the knife into the unlocking position includes an electromagnet.

10. The combination of claim 5 wherein the means for feeding the projectiles through the passage to the transfer zone includes a jack.

* * * * *